US007070466B1

(12) United States Patent
Legatzke

(10) Patent No.: US 7,070,466 B1
(45) Date of Patent: Jul. 4, 2006

(54) SWIMMERS PADDLE WHEEL

(76) Inventor: David K. Legatzke, 16448 San Jose St., Granada Hills, CA (US) 91344

( * ) Notice: Subject to any disclaimer, the term of this patent is extended or adjusted under 35 U.S.C. 154(b) by 0 days.

(21) Appl. No.: 11/141,949

(22) Filed: Jun. 2, 2005

(51) Int. Cl.
*B63H 16/20* (2006.01)

(52) U.S. Cl. ..... 440/26; D12/306

(58) Field of Classification Search ..... 440/26–28
See application file for complete search history.

(56) References Cited

U.S. PATENT DOCUMENTS 1,777,749 A * 10/1930 Eguiluz ..... 440/27
D254,485 S * 3/1980 Stevens ..... D12/306
4,500,297 A * 2/1985 Boulva ..... 440/27
D416,960 S * 11/1999 Chen ..... D21/678

* cited by examiner

*Primary Examiner*—Jesus D. Sotelo
(74) *Attorney, Agent, or Firm*—Albert O. Cota

(57) ABSTRACT

A swimmers paddle wheel (10) that utilizes a crankshaft (20) with a pair of ends (22,24) containing crank arms (28). Each crank arm (28) is out of angular alignment relative to each other, and each crank arm includes a handle grip (46) with a rotating cylinder (48) and a resilient hand grip (50) such that a swimmer may grasp a handle grip (46) with each hand and rotate the crankshaft (20). Floats (52,54) are disposed on each end (22,24) of the crankshaft (20), with the floats (52,54) having a plurality of paddle blades (56) extending outward to provide propulsion when manually rotated within a body of water. A removable swimmer seat (64) is attached to the crankshaft (20) and is used to support a swimmer when stationary in the water or when the paddle blades (56) are rotated.

19 Claims, 4 Drawing Sheets

SWIMMERS PADDLE WHEEL

TECHNICAL FIELD

The invention generally pertains to swimmers assisting devices, and more particularly to a floatable paddle wheel with utility for propulsion and flotation of recreational and rehabilitational swimmers.

BACKGROUND ART

Previously, many types of paddle wheels have been used to provide a means for propelling a swimmer by manually rotating the paddles on the wheels. Many or most paddle wheels also provide floatation for the swimmer with inflatable wheels or floats having hinged paddles for added propulsion by folding backwards during the reverse sweep.

A search of the prior art did not disclose any patents that possess the novelty of the instant invention, however the following U.S. patents are considered related:

| U.S. Pat. No. | Inventor | Issue Date |
|---|---|---|
| 1,777,749 | Eguiluz | Oct. 7, 1930 |
| 2,416,471 | De Chappedelaine | Feb. 25, 1947 |
| 3,580,213 | Yuen | May 25, 1971 |
| 5,649,845 | Fechtner | Jul. 22, 1997 |

Eguiluz in U.S. Pat. No. 1,777,749 teaches a swimming apparatus that addresses three main fundamental purposes: a safety device for swimmers, an exercise device and an instructive device. The apparatus may be used to teach basic swimming and as an exercise device, and can be used to develop proper swimming strokes. The invention consists of a pair of floats and an intermediate crank shaft. The crank shaft has two crank arms and means to adjust the throw of the crank arms relative to each other for adapting the length of the apparatus to an individual swimmer. Each float consists of a buoyant member with paddles that are pivoted and spring-loaded to permit folding down during a backward movement of the paddle and yet are rigid during a forward sweep. The paddles are also removable for transportation and storage.

U.S. Pat. No. 2,416,471 issued to De Chappedelaine is for a water sport device that acts as a sport game by using the cyclic movement of a swimmer's hands, and as a life saver since the device is buoyant. The invention consists of a pair of similarly-shaped inflatable floats in a sinuous form and a crankshaft that spaces the floats apart. Hand grips are rotatably mounted on the crankshaft and the floats are inflated with a hand air pump. The floats are made of a flexible air-tight and waterproof material such as rubber, rubberized fabric or flexible plastic, with an air valve provided for inflation.

Yuen in U.S. Pat. No. 3,580,213 discloses swimming paddles that consist of a shaft having opposite-extending offset portions at opposite ends, with each portion being connected to a corresponding flotation paddle. Straps secure the shaft rotatably to a swimmer. The swimmer manually rotates the shaft, thereby propelling him or her in the water. The paddles are lighter than water and act as floats, as well as assisting in propulsion. The paddle wheels have spaced-apart radially-extending vanes or paddles, and the horizontal shaft has offset arms. Additionally, to add to the utility of the invention the wheels can be inflatable.

U.S. Pat. No. 5,649,845 of Fechtner is for a swimming paddle assembly having a long shaft with a rigid blade on each end. A pair of resilient flaps are attached to the leading edge of each blade, one on each side such that a swimmer pulls first on one side and then on the other.

For background purposes and as indicative of the art to which the invention is related reference may be made to the remaining cited patents issued to Kuznetrzoff in U.S. Pat. No. 1,349,891, Huebner in U.S. Pat. No. 2,009,551, Eriksen in U.S. Pat. No. 3,510,894, Alonzo in U.S. Pat. No. 5,114,371 and Fechtner in U.S. Pat. No. 5,348,503.

DISCLOSURE OF THE INVENTION

Manually rotated paddle wheels for propelling swimmers have been developed in their simplest form since almost the turn of the twentieth century. While prior art paddle wheels have provided propulsion and buoyancy, improvements have achieved viable advances that fill the need to accommodate not only the average adult but also a wide range of users that heretofore had to utilize a single size paddle wheel.

Therefore, the primary object of the invention is to provide a swimmers paddle wheel that allows adjustment in width of a crankshaft to accommodate people of various sizes and reach. The stature of a person normally requires height adjustment of the paddle wheel's seat, which is easily accomplished since the invention employs detents that are easy to use and well known in the art.

An important object of the invention is that when a seat is used with the paddle wheel, the invention is particularly useful for rehabilitation of persons that are overcoming muscular disabilities and must exercise within water or have a body of water available for normal exercise procedures.

Another object of the invention is that the seat provided allows a person to rest during exercise, or if a person has not yet learned to swim the buoyancy maintains the person safely above the water. Additionally, the invention provides propulsion that is required to move a swimmer in a desired direction.

Still another object of the invention is the ease of transportation, as the device may be disassembled into small components which are easily moved and stored.

Yet another object of the invention is the paddle wheel's weight, which is light enough to be easily handled, either fully assembled or when taken apart for storage.

A further object of the invention is that the paddle wheel is fabricated of common materials and components, such as die-cut closed-cell floats and seats, and a thermoplastic tubular crankshaft, with little labor required as the final assembly is accomplished by the user, thereby permitting the invention to be cost effective from both a manufacturer's and consumer's point of view.

A final object of the invention is realized in the use of open-cell foam material in the paddle wheel's rotating handle grips which are soft, provide positive gripping, and are not slippery when wet.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
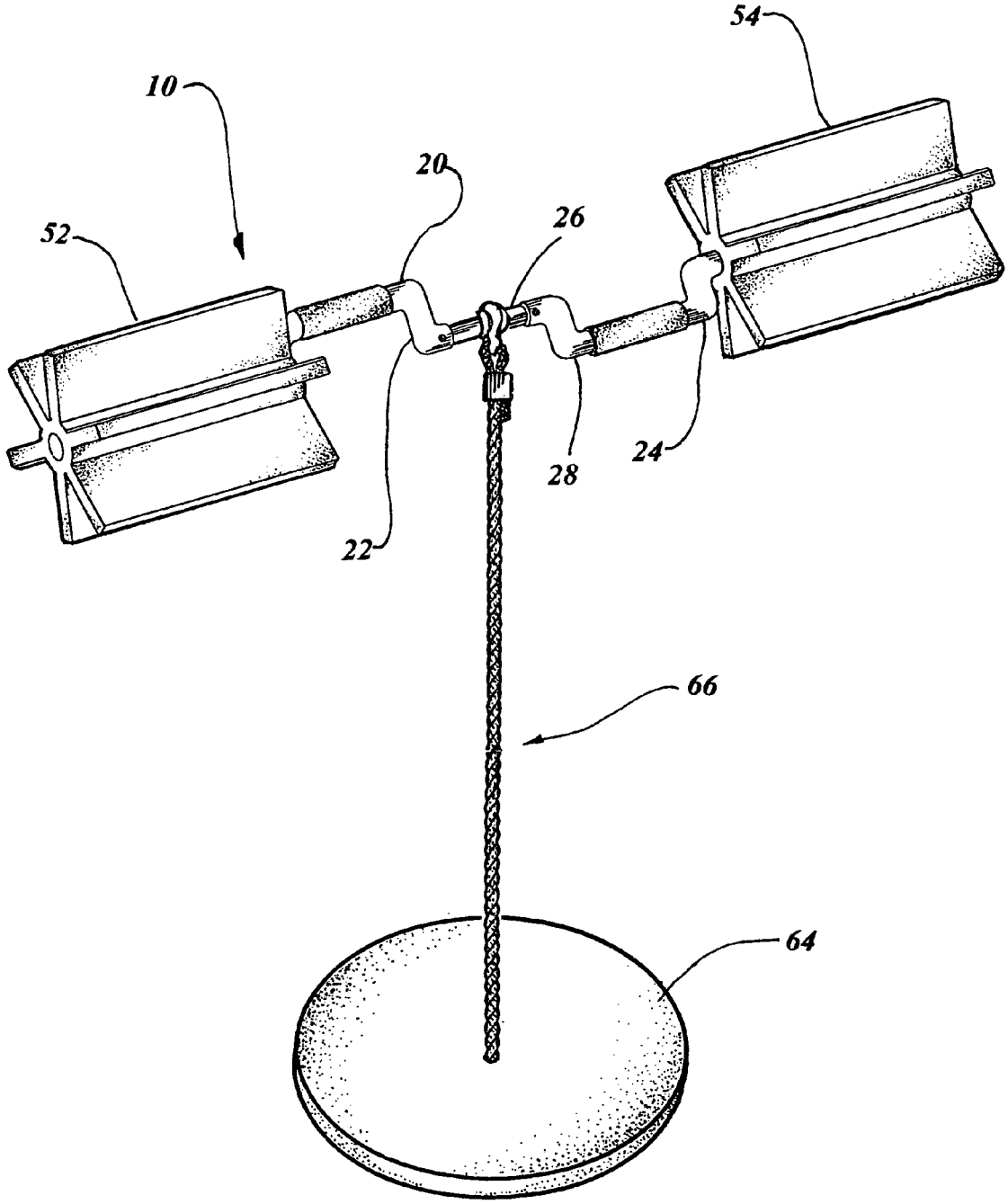
FIG. 1 is a partial isometric view of the preferred embodiment with a flexible line retaining the removable swimmer seat.
Figure 6:
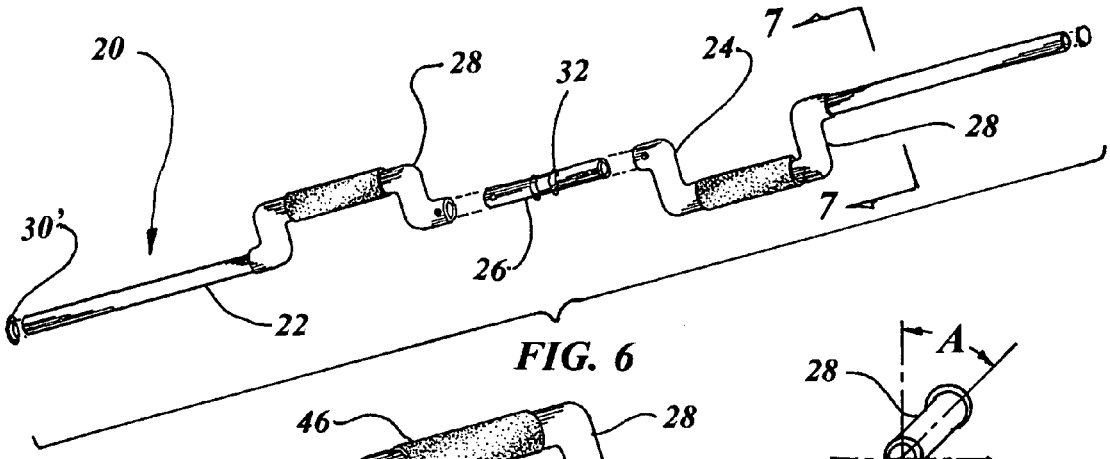
FIG. 6 is an exploded partial isometric view of the crankshaft in the preferred embodiment.
Figure 8:
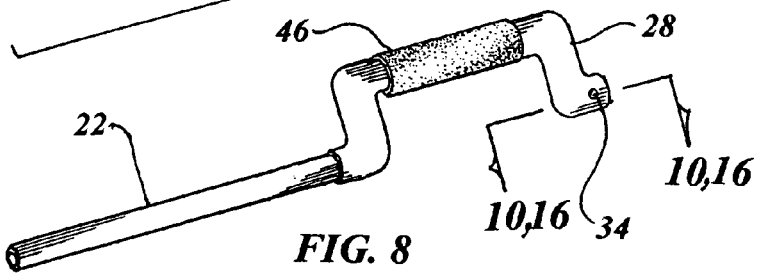
FIG. 8 is an isometric view of the crankshaft first end in the preferred embodiment.
Figure 7:
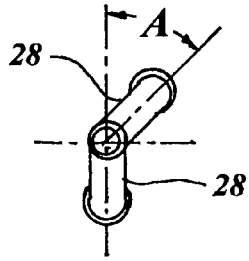
FIG. 7 is a cross-sectional view taken along lines 7—7 of FIG. 6 illustrating that each crank arm is angularly out of alignment with each other.

The best mode for carrying out the invention is presented in terms of a preferred embodiment for a swimmers paddle wheel 10, as shown in FIGS. 1 through 20. The paddle wheel 10 is comprised of a crankshaft 20 that includes a first end 22, a second end 24 and center section 26. Offset crank arms 28 in opposed pairs are positioned between the center section 26 and the ends 22 and 24, as shown in FIGS. 1, 6 and 8. The crank arms 28 are out of alignment relative to each other by being angularly slanted from 40 degrees to 50 degrees, with 45 degrees preferred, as shown in FIG. 7. The angular slanting relationship is designated with the alpha character "A" in FIG. 7. The reason for the misalignment is to provide an optimum balance and to place the gripping portion of the crank arms 28 also in an optimum ergonomic position.

Figure 10:
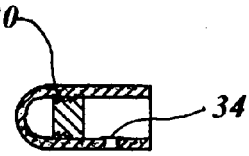
FIG. 10 is a cross-sectional view taken along lines $\mathbf{10}^{-10}$ of FIG. 8.
Figure 14:
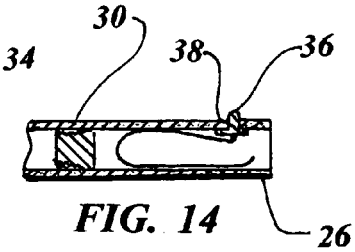
FIG. 14 is an arbitrary cross-sectional view taken on the vertical center line of one of the center sections of the crankshaft illustrating the plug and the inner detent.
Figure 16:
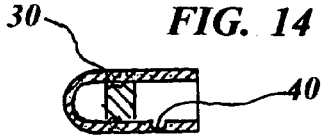
FIG. 16 is a cross-sectional view taken along lines 16—16 of FIG. 8.

The crankshaft first end 22, second end 24 and center section 26 are preferably a hollow thermoplastic tube and have internal plugs 30, as shown in FIGS. 10, 14 and 16, that prevent water from entering, thus adding to the buoyancy of the paddle wheel 10. The typical plug 30 is preferably made of resilient rubber or thermoplastic, as shown in the cross sections of FIGS. 10, 14 and 16. A cap plug 30' is used to plug the open end of the crankshaft first end 22 and second end 24, and is of the same basic material as the internal plugs 30.

The material of the thermoplastic crankshaft tube may consist of polyvinyl chloride (PVC), polyvinylidene fluoride (PVDF) or any other suitable plastic pipe and tubing material.

Figure 11:
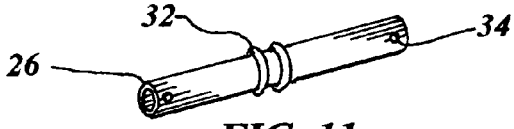
FIG. 11 is a partial isometric view of a short length center section in the preferred embodiment completely removed from the invention for clarity.
Figure 12:
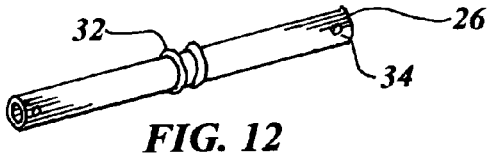
FIG. 12 is a partial isometric view of a medium length center section in the preferred embodiment completely removed from the invention for clarity.

The center section 26 is variable in length to accommodate the physical stature of the swimmer using the paddle wheel. As an example, FIG. 11 shows a small length center section having a length of 4-inches (10.2 cm), FIG. 12 shows a medium length center section having a length of 6-inches (15.2 cm), and FIG. 13 shows a large length center section having a length of 12-inches (30.5 cm).

The center section 26 also contains a pair of spacer rings 32 that are located in the middle of the center section 26 and are separated, thereby forming a groove-like indention in between, as shown in FIGS. 1, 6, and 11–13. The rings 32 are preferably made of thermoplastic, which is the same material used for the center section 26. The rings 32 are also preferably semi-circular in cross-section, thus allowing the flat side to slip over the round hollow tube of the mating center section 26 and be cemented in place or integrally formed.

Figure 13:
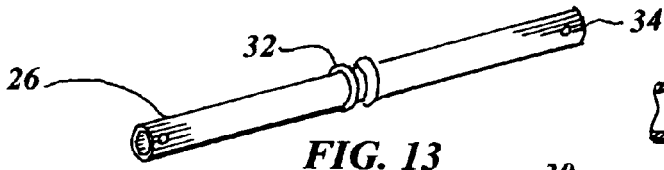
FIG. 13 is a partial isometric view of a long length center section in the preferred embodiment completely removed from the invention for clarity.

In order to permit assembly or disassembly of the center section 26 from the crankshaft ends 22 and 24, the ends 22 and 24 preferably have a detent hole 34, as shown in FIG. 13, and the center section 26 has a detent 36 within a bore 38, as shown in FIG. 14. The preferred detent 36 is the spring-loaded type, which consists of a plunger with an enlarged base and a U-shaped spring that fits within the hollow center section 26. The detent plunger is disposed within the bore 38, with the base limiting its protrusion and the spring maintaining its outward-extending position. When the detent plunger is manually depressed the center section 26 is slipped into the crankshaft end 22 or 24, and the plunger snaps into the mating detent hole 34. For illustrative purposes, only one detent bore 38 and one detent 36 are shown in FIG. 14. However, for additional pole attachment security, a second detent bore 38 and a second detent 36 can be located at 180-degrees from the first detent bore 38 and detent 36.

An alternate to the detent hole 34 in the crankshaft ends 22 or 24 is an indentation 40, as shown in FIG. 16, that interfaces with the detent plunger and holds the joint together with the plunger urged into the indention 40 by spring pressure. When the center section 26 is to be disassembled the mating parts may simply be pulled apart, with the plunger deflected out of the indentation 40 when sufficient force is applied.

Figure 15:
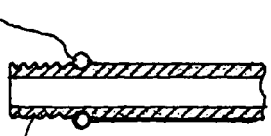
FIG. 15 is an arbitrary cross-sectional view taken on the vertical center line of one of the center sections of the crankshaft depicting an optional threaded joint with an O-ring seal.

While the detent system is preferred, the crankshaft end sections 22 and 24 may utilize any disconnect means that is well known in the art. For example, FIG. 15 shows a threaded joint having male straight threads 42 on the center section 26, and female threads on the mating crankshaft ends 22 or 24. In order to provide a waterproof joint, an O-ring 44, as shown in FIG. 15, is seated into a groove adjacent the threads 26 that interface with the crankshaft ends 22 or 24. The O-ring 44 compresses when the joint is tightly threaded to create a hermetic seal.

It should be noted that the detent 36 requires the hollow tube to be open, therefor the plug 30 is required at each end of the joint to maintain the air-tight integrity of the crankshaft 20. Further, the cap plug 30' is used to close the outer end of the crankshaft first and second end 22 and 24 opposite the crank arms 28.

Figure 9:
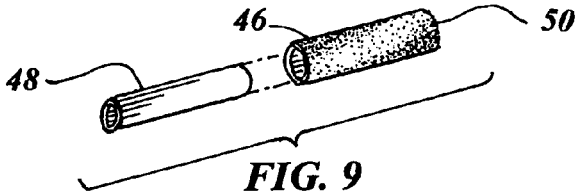
FIG. 9 is an exploded isometric view of the handle grip and rotatable cylinder in the preferred embodiment completely removed from the invention for clarity.

Each crank arm 28 includes a retained revolving handle grip 46 that provides the means for a swimmer to grasp the handle grip 46 with each hand and to rotate the crankshaft 20 without the necessity of changing the swimmer's hand angle position. FIG. 9 shows the handle grip 46 in an exploded view showing a rotatable cylinder 48 that is configured to slide over each crank arm 28, with the cylinder 48 covered on its outer surface with a resilient hand grip 50. The cylinder provides free rotation, while the hand grip 50 is for operator comfort and to provide a non-slip surface.

Figure 2:
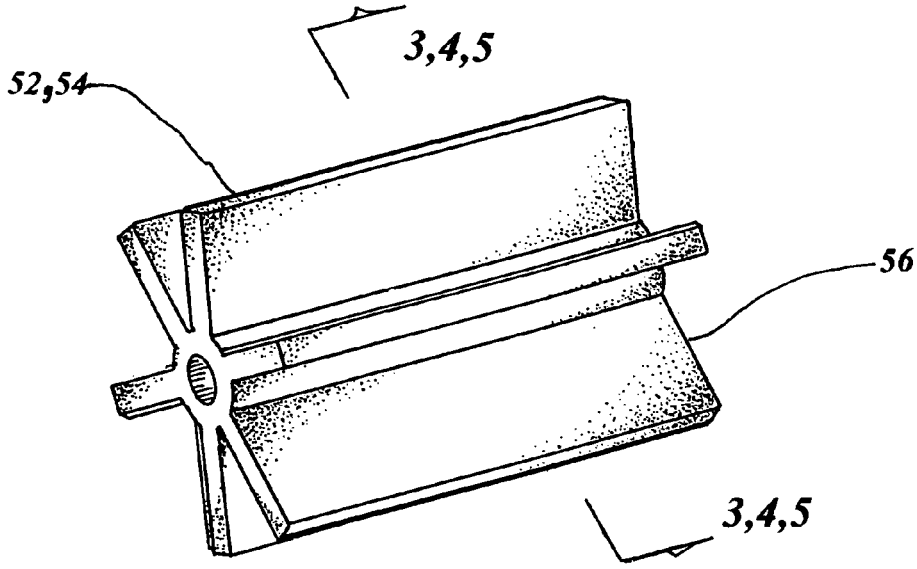
FIG. 2 is a partial isometric view of one of the paddle wheel floats in the preferred embodiment completely removed from the invention for clarity.

The swimmers paddle wheel 10 incorporates a first wheel float 52 disposed on the crankshaft first end 22, and a second wheel float 54 disposed on the crankshaft second end 24. Each float 52 and 54 has a plurality of paddle blades 56 extending outward therefrom in a horizontal transverse patterns. The blades 56 provide propulsion within a body of water when manually rotated. The floats 52 and 54 are shown in FIG. 2.

Figure 3:
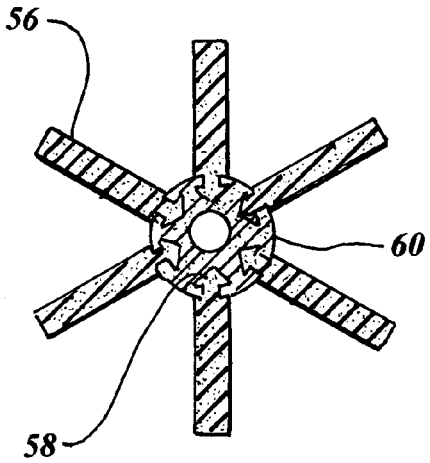
FIG. 3 is a cross-sectional view taken along lines 3—3 of FIG. 2 illustrating the interlocking dovetail variant of the removable paddle blade configuration.
Figure 4:
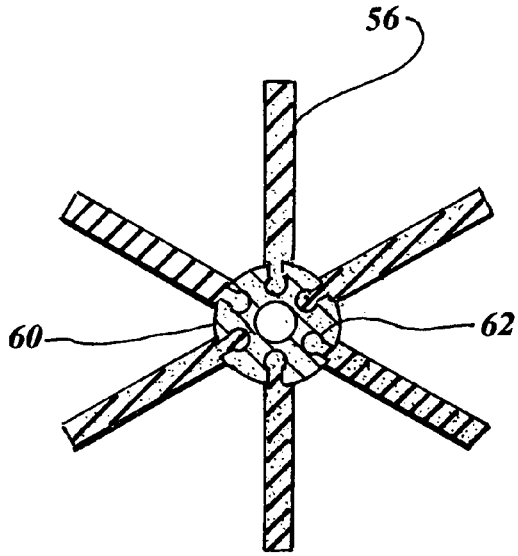
FIG. 4 is a cross-sectional view taken along lines 4—4 of FIG. 2 illustrating the interlocking ball and socket variant of the removable paddle blade configuration.
Figure 5:
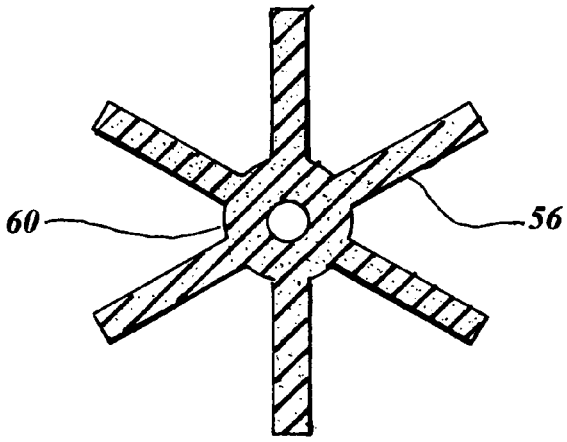
FIG. 5 is a cross-sectional view taken along lines 5—5 of FIG. 2 illustrating the integral blade variant of the paddle wheel floats.

The blades 56 may be integrally formed, as shown in FIG. 5, or may be removable, as shown in FIGS. 3 and 4. Two separate variations are illustrated as possible embodiments, with FIG. 3 depicting an interlocking dovetail 58 interface between the blades 56 and the remainder of the float, which is designated as the float cylindrical body 60. The dovetail configuration allows the blades 56 to be slid into the dovetail 58 interface, thus allowing easy replacement for the various sized blades 56 and for removal during transportation and storage. Since the swimmers paddle wheel 10 may be used by any sized swimmer, various length blades 56 that accommodate the strength and endurance of the swimmer may be utilized by simply replacing the blades 56. FIG. 3 shows a small length blade 56, FIG. 5 shows a medium length blade 56, and FIG. 4 shows a large length blade, however any other alternative length may be used with equal ease and dispatch. FIG. 4 shows the wheel float cylindrical body 60 having a ball and socket 62 interface located between the blades 56 and the body 60, which allows the blades 56 to be slid into the ball and socket 62.

The integral and removable paddle blades 56 and cylindrical body 60 are formed of an ultraviolet (UV) resistant closed-cell semi-rigid sponge material such as polyurethane, polyethylene, silicone, polyvinyl, blended rubber or the like. Further, the resilient hand grip 50 may be of the same base material as described above except in an open-cell formulation.

A removable swimmer seat 64 is attached to the crankshaft 20 at the midpoint of the center section 26, with the seat 64 used for supporting a swimmer. Two variations of the connection between the swimmer seat 64 and the crankshaft 20 are presented.

Figure 17:
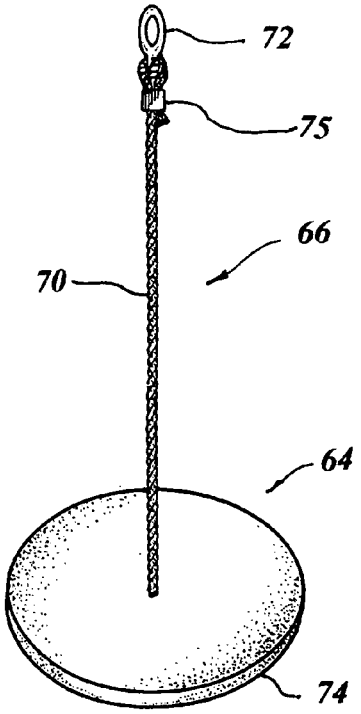
FIG. 17 is a partial isometric view of the swimmers seat in the flexible line variation of the preferred embodiment completely removed from the invention for clarity.
Figure 18:
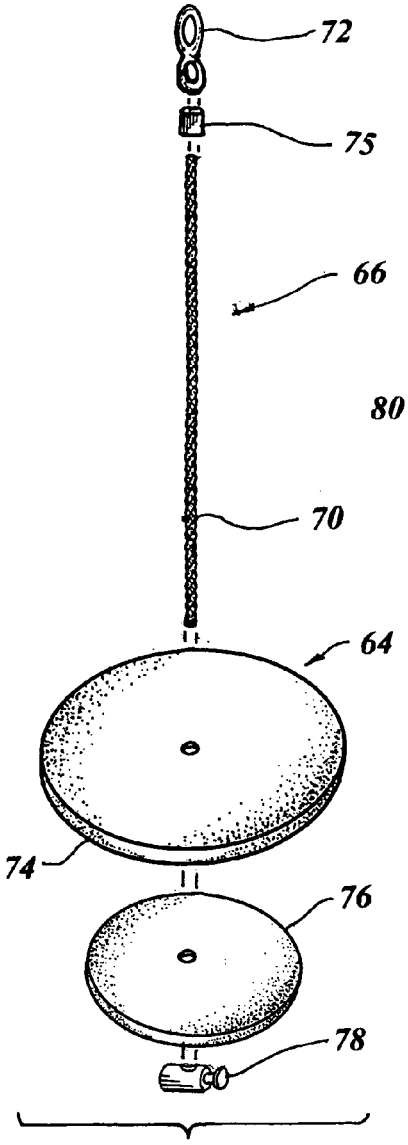
FIG. 18 is an exploded partial isometric view of the swimmers seat in the flexible line variation of the preferred embodiment completely removed from the invention for clarity.

The first variation utilizes a flexible line 66 which has a rope 70 that is preferably connected to a closed double-end figure-eight hook 72, that has an attachment means for clamping the end of the rope and forming a loop through the hook 72, such as a metal compression clamp 75, a knot or lashing. The figure-eight hook 72 rotatably interfaces with the center section 26 of the crankshaft 20 in between the centrally located spacer rings 32. The spacer rings 32 are sufficiently separated from each other to permit the figure-eight hook 72 to be forced over one of the rings 32, thereby retaining the figure-eight hook 72 therebetween in a removable manner. The rope 70 may be formed from a conventional material such as manila, nylon, polyester, polypropylene or KEVLAR or any other suitable substance. FIG. 17 shows the flexible line 66 assembled, and FIG. 18 shows the line 66 in an exploded view.

Figure 19:
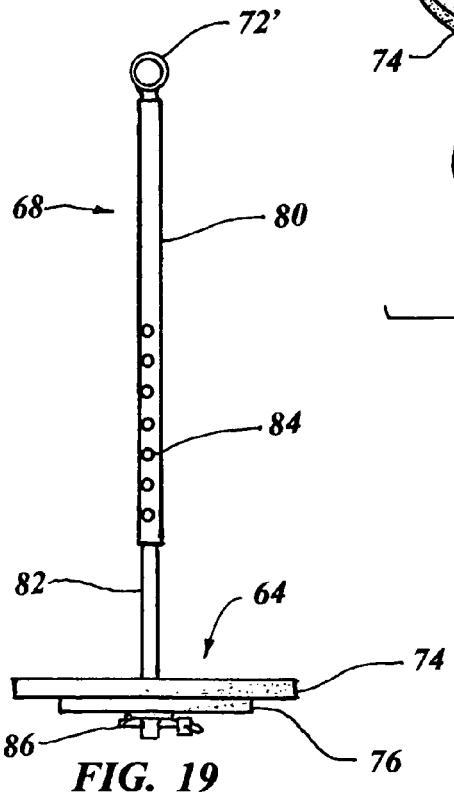
FIG. 19 is a side elevational view of the swimmers seat in the rigid pole variation of the preferred embodiment completely removed from the invention for clarity
Figure 20:
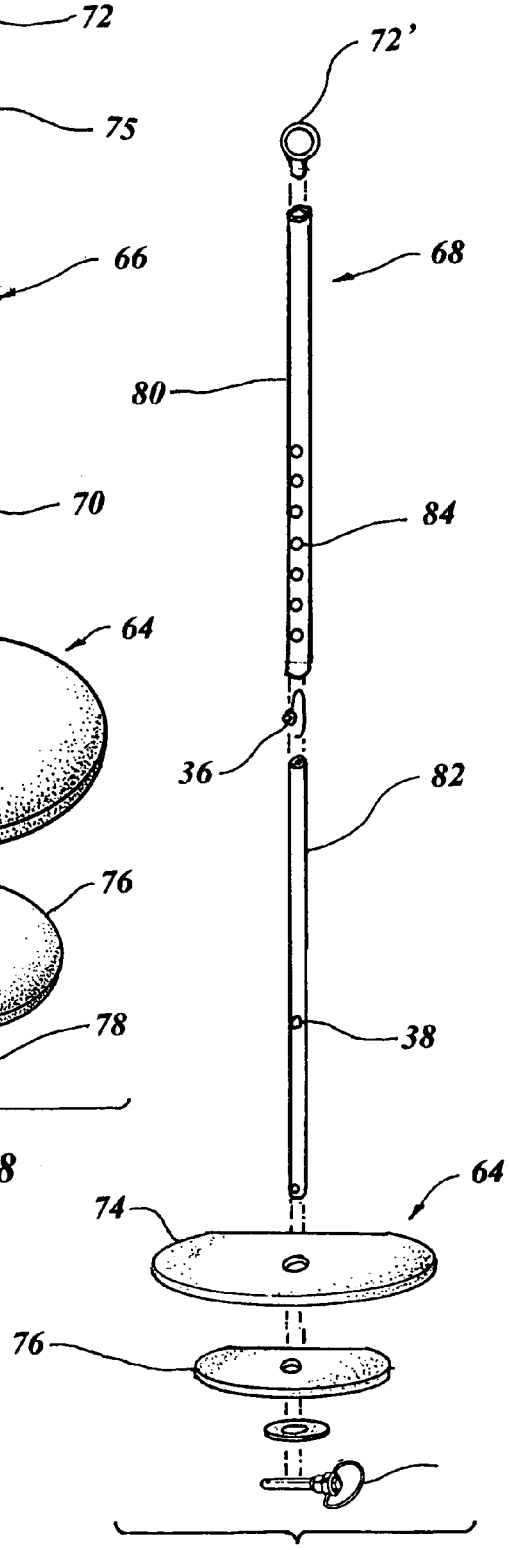
FIG. 20 is an exploded partial isometric view of the swimmers seat in the rigid pole variation of the preferred embodiment completely removed from the invention for clarity.

The flexible line 66 includes a foam seat 74 with a plastic reinforcing backing 76 attached thereto in a length adjustable manner. The seat 74, as shown in FIGS. 17–19, is configured as a round seat but may be any shape that would be comfortable for a swimmer, such as a truncated elliptical shape, as shown in FIG. 20. The length adjustment is preferably accomplished by using a push-button locking closure 78 that is slideably attached to the rope 70. The adjustment is achieved by manually depressing the push button of the locking closure 78 and sliding the closure along the rope 70 until the desired height of the seat 74 is attained.

The second variation utilizes a rigid pole 68 having an adjustable length pole assembly that is located between the swimmer foam seat 74 and the crankshaft 20. FIG. 19 shows the rigid pole 68 assembled, and FIG. 20 shows the rigid pole 68 exploded to illustrate all of the components necessary to define the adjustable rigid feature. The rigid pole 68 further utilizes the same foam seat 74 with the plastic reinforcing backing 76 as the flexible line 66 first variation. The foam seat 74 and reinforcing backing 76 are shown in FIGS. 19 and 20 with a different shape than above, which is optical as far as overall configuration is concerned. A lock pin 86 is positioned through a rigid pole inner tube 82 beneath the foam seat 74, thereby permitting the foam seat 74 and reinforcing backing 76 to be removed for transportation and storage.

The pole 68 consists of a plastic outer tube 80 and a plastic inner tube 82, which slideably mate one inside the other in order to provide the desired length regulation. The plastic outer tube 80 includes a plurality of in-line adjustment holes 84 that penetrate through one side. The plastic inner tube 82 has a detent 36 that penetrates a bore 38 therein, as previously described, such that the detent 36 interfaces with a selected adjustment hole 84 in the outer tube 80 to provide the desired length of the rigid pole 68.

An eye hook 72' is permanently attached to the upper end of the outer tube 80, as shown in FIGS. 19 and 20. The eye hook 72' functions in the same manner as the figure-eight hook 72 by rotatably interfacing with the center section 26 of the crankshaft 20 in between the centrally located spacer rings 32. The eye hook 72' is forced over one of the spacer rings 32 that retain the eye hook 72', while allowing removal by employing a reverse procedure.

In either the flexible line 66 variation or the rigid pole 68 variation the seat 74 is made of the same material, such as a closed-cell semi-rigid sponge material including polyurethane, polyethylene, silicone, polyvinyl, blended rubber or the like. The reinforcing backing 76 is made of a rigid thermoplastic such as polyethylene, polycarbonate, poly vinyl chloride, polystyrene, polyester or a variety of other readily available materials that can provide UV protection.

To utilize the invention if the component parts are disassembled, the assembly process is repeated in the opposite order, and if adjustment is necessary, the desired length of center section 26 may be selected and inserted into the crankshaft ends 22 and 24. The height of the foam seat 74 may be adjusted as described above, and if the removable paddle blades 56 are utilized, the proper width may be selected and slid into the cylindrical body of the float 60. The swimmer may then enter the water with the invention, sit on the foam seat 74 for buoyancy, and then paddle or rotate the crank arms 28 for propulsion.

While the invention has been described in detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A swimmers paddle wheel comprising:

a) a crankshaft having a first end with a crank arm, a second end with a crank arm, and a center section in between the crank arms, with each crank arm out of angular alignment relative to each other, and each crank arm having a handle thereon such that a swimmer may grasp a handle with each hand and rotate the crankshaft, wherein said crankshaft first end, second end and center section further comprise a hollow thermoplastic tube having plugs on the tube's open ends to prevent water from entering, thus adding to the buoyancy of the paddle wheel, b) a float disposed on each crankshaft end, with said floats having a plurality of paddles extending outward therefrom for propulsion within a body of water when manually rotated, and d) a removable swimmer seat attached to said crankshaft for supporting a swimmer.

2. A swimmers paddle wheel comprising:

a) a crankshaft having a first end, a second end and a center section with a pair of offset crank arms positioned between the center section and each end, with said crank arms out of alignment relative to each other by being angularly slanted from 40 degrees to 50 degrees to assure optimum balance, b) each crank arm having a retained revolving handle grip thereon such that a swimmer may grasp the handle grip with each hand and rotate the crankshaft without changing the balance and hand angle position, c) a first wheel float disposed on the crankshaft first end, and a second wheel float disposed on the crankshaft second end, with both floats having a plurality of paddle blades extending outward therefrom in a horizontal transverse pattern for propulsion within a body of water when manually rotated, and d) a removable swimmer seat attached to said crankshaft at a midpoint of the center section, said seat for supporting a swimmer.

3. A swimmers paddle wheel comprising:

a) a crankshaft having a first end a second end and a center section with a air of offset crank arms positioned between the center section and each end with said crank arms out of alignment relative to each other by being angularly slanted from 40 degrees to 50 degrees to assure optimum balance, wherein said crankshaft first end, second end and center section further comprise a hollow thermoplastic tube having plugs on the tube's open ends to prevent water from entering, thus adding to the buoyancy of the paddle wheel, b) each crank arm having a retained revolving handle grip thereon such that a swimmer may grasp the handle grip with each hand and rotate the crankshaft without changing the balance and hand angle position, c) a first wheel float disposed on the crankshaft first end and a second wheel float disposed on the crankshaft second end, with both floats having a plurality of paddle blades extending outward therefrom in a horizontal transverse pattern for propulsion within a body of water when manually rotated, and d) a removable swimmer seat attached to said crankshaft at a midpoint of the center section, said seat for supporting a swimmer.

4. The swimmers paddle wheel as recited in claim 3 wherein said center section is variable in length to accommodate the physical stature of the swimmer using the paddle wheel.

5. The swimmers paddle wheel as recited in claim 3 wherein each retained revolving handle grip further comprises a rotatable cylinder that is configured to slide over each crank arm, with said cylinder covered on its outer surface with a resilient hand grip for comfort and to provide a non-slip surface.

6. The swimmers paddle wheel as recited in claim 3 wherein said first wheel float and said second wheel float further comprise integral paddle blades.

7. The swimmers paddle wheel as recited in claim 3 wherein said first wheel float and said second wheel float further comprise removable paddle blades.

8. The swimmers paddle wheel as recited in claim 7 wherein said removable paddle blades further comprise a plurality of discrete closed-cell semi-rigid blades and a wheel float cylindrical body having an interlocking dovetail interface located between the blades, and wherein the body allows the paddle blades to be slid into the dovetail interface for replacement when smaller or larger sized blades are required for more or less resistance in water, and for removal during transportation and storage.

9. The swimmers paddle wheel as recited in claim 7 wherein said removable paddle blades further comprise a plurality of discrete closed-cell semi-rigid blades and a wheel float cylindrical body having a ball and socket interface located between the blades, and wherein the body allows the paddle blades to be slid into the ball and socket interface for replacement when smaller or larger sized blades are required for more or less resistance in water, and for removal during transportation and storage.

10. The swimmers paddle wheel as recited in claim 3 further comprising a flexible line that is located between the swimmer seat and the crankshaft.

11. The swimmers paddle wheel as recited in claim 10 wherein said flexible line is a rope having a closed double-end figure-eight hook which is attached with means for clamping the end of the rope, therefore forming a loop, and wherein said crankshaft having a pair of centrally located spacer rings that are spaced apart to permit the figure-eight hook to be forced over one of the spacer rings, thereby retaining the figure-eight hook therebetween in a removable manner.

12. The swimmers paddle wheel as recited in claim 10 wherein said flexible line further having a foam seat with plastic reinforcing backing attached thereto in a length adjustable manner.

13. The swimmers paddle wheel as recited in claim 12 wherein said length adjustment is comprised of a push-button locking closure that is slideably attached to the rope such that adjustment is achieved by manually depressing the push button of the locking closure and sliding the closure along the rope until the desired length of the seat is attained.

14. The swimmers paddle wheel as recited in claim 3 further comprising a rigid pole that is located between the swimmer seat and the crankshaft.

15. The swimmers paddle wheel as recited in claim 14 wherein said rigid pole further comprises a plastic outer tube, and a plastic inner tube that is slideably disposed within the outer tube in a length adjustable manner.

16. The swimmers paddle wheel as recited in claim 15 wherein said rigid pole length adjustable manner further comprises said plastic outer tube having a plurality of adjustment holes therethrough, and said plastic inner tube having at least one detent therein such that the detent interfaces with a selected at least one adjustment hole in the outer tube to provide a desired length of the pole.

17. The swimmers paddle wheel as recited in claim 16 wherein said plastic outer tube further comprises an eye hook on the upper end of said outer tube, and wherein said crankshaft has a pair of centrally located spacer rings that are separated to permit the eye hook to be forced over one of the spacer rings, thereby retaining the eye hook therebetween in a removable manner.

18. The swimmers paddle wheel as recited in claim 14 wherein said rigid pole further having a foam seat with a plastic reinforcing backing attached thereto.

19. The swimmers paddle wheel as recited in claim 18 wherein said rigid pole further comprises a lock pin that is positioned through the rigid pole beneath the foam seat, thereby permitting the foam seat and reinforcing backing to be removed for transportation and storage.

* * * * *